US005078715A

United States Patent [19]

Daar et al.

[11] Patent Number: 5,078,715

[45] Date of Patent: Jan. 7, 1992

[54] DEPILATORY DEVICE

[76] Inventors: Yair Daar, Moshav Galia; Shimon Yahav, 90 Tchernokovsky Street, Rehovot, both of Israel

[21] Appl. No.: 347,917

[22] Filed: May 5, 1989

[30] Foreign Application Priority Data

May 19, 1988 [IL] Israel ..... 86447

[51] Int. Cl.[5] ..... A61B 17/00

[52] U.S. Cl. ..... 606/43; 606/133; 606/36

[58] Field of Search ..... 30/43.4, 43.5, 43.6, 30/43.7, 43.8; 606/36, 43, 133, 134

[56] References Cited

U.S. PATENT DOCUMENTS

| | | | |
|---|---|---|---|
| 1,232,617 | 7/1917 | Shipp . | |
| 1,743,590 | 1/1930 | Binz . | |
| 1,875,980 | 9/1932 | Bingham . | |
| 1,923,415 | 8/1933 | Bingham . | |
| 2,083,380 | 6/1937 | Hudson . | |
| 2,112,230 | 3/1938 | Fisher . | |
| 2,423,245 | 7/1947 | Magnus . | |
| 2,458,911 | 1/1949 | Kerr . | |
| 2,486,616 | 1/1949 | Schubiger . | |
| 2,496,223 | 1/1950 | Lanzisera . | |
| 2,592,484 | 4/1952 | Smith . | |
| 2,638,623 | 5/1953 | Hanscomb . | |
| 2,900,661 | 8/1959 | Schnell . | |
| 3,150,409 | 9/1964 | Wilcox . | |
| 3,613,690 | 10/1971 | Newell . | |
| 3,911,530 | 10/1975 | Kalfsbeek et al. . | |
| 4,079,741 | 3/1978 | Daar et al. . | |
| 4,171,701 | 7/1977 | Walter . | |
| 4,279,253 | 7/1981 | Haes | 606/133 |
| 4,524,772 | 6/1985 | Daar et al. . | |
| 4,575,902 | 3/1986 | Alazet | 19/2 |
| 4,726,375 | 2/1988 | Gross et al. . | |
| 4,807,624 | 2/1989 | Gross et al. . | |
| 4,825,867 | 5/1989 | Gross et al. | 606/133 |
| 4,830,004 | 5/1989 | Alazet . | |
| 4,917,678 | 4/1990 | Lock et al. | 606/133 |
| 4,960,421 | 11/1990 | Daar et al. . | |

FOREIGN PATENT DOCUMENTS

| | | |
|---|---|---|
| 0270222 | 10/1987 | European Pat. Off. . |
| 2650969 | 6/1977 | Fed. Rep. of Germany . |
| 667265 | 10/1929 | France . |
| 737028 | 12/1932 | France . |
| 788130 | 10/1935 | France . |
| 1017490 | 12/1952 | France . |
| 1123971 | 10/1956 | France . |
| 1151495 | 1/1958 | France . |
| 2126084 | 10/1972 | France . |
| 2245314 | 4/1975 | France . |
| 2307491 | 11/1976 | France . |
| 2334320 | 7/1977 | France . |
| 2454283 | 11/1980 | France . |
| 2556939 | 6/1985 | France . |
| 2598067 | 5/1986 | France . |
| 61702 | 12/1978 | Greece . |
| 179261 | 1/1936 | Switzerland . |
| 268696 | 9/1950 | Switzerland . |
| 652899 | 12/1985 | Switzerland . |
| 203970 | 9/1923 | United Kingdom . |
| 225445 | 12/1924 | United Kingdom . |
| 788072 | 12/1957 | United Kingdom . |

*Primary Examiner*—Robert A. Hafer
*Assistant Examiner*—Kerry Owens
*Attorney, Agent, or Firm*—Helfgott & Karas

[57] ABSTRACT

An electrically powered human hair depilatory device including a hand held portable housing, first and second hair engagement elements defining respective first and second hair engagement surfaces having different surface hardnesses and a motor for driving at least one of said first and second hair engagement elements in relative motion, whereby hair is engaged between the first and second hair engagement surfaces and thus removed.

19 Claims, 15 Drawing Sheets

DEPILATORY DEVICE

FIELD OF THE INVENTION

The present invention relates to depilatory devices and techniques generally and more particularly to powered mechanical depilatory devices.

BACKGROUND OF THE INVENTION

Various types of mechanical depilatory devices have been proposed and are known in the marketplace.

In applicants' U.S. Pat. No. 4,524,772 there is described an electrically powered depilatory device including a hand held portable housing, motor apparatus disposed in the housing, and a helical spring comprising a plurality of adjacent windings arranged to be driven by the motor apparatus in rotational sliding motion relative to the skin bearing hair to be removed, the helical spring including an arcuate hair engaging portion arranged to define a convex side whereat the windings are spread apart and a concave side corresponding thereto whereat the windings are pressed together, the rotational motion of the helical spring producing continuous motion of the windings from a spread apart orientation at the convex side to a pressed together orientation at the concave side for engagement and plucking of hair from the skin, whereby the surface velocities of the windings relative to the hair greatly exceeds the surface velocity of the housing relative thereto.

The above-described device has met with very considerable commercial success throughout the world. The Background of the Invention section of U.S. Pat. No. 4,524,772 describes the most relevant prior art relative thereto including, inter alia, Swiss Patent 268,696.

Following the publication and public introduction of the above-described device of applicants, additional versions of mechanical depilatory devices have also been proposed, for example in various patents which are exemplary of the art: U.S. Pat. No. 4,079,741; U.S. Pat. No. 4,726,375; U.S. Pat. No. 2,492,484; French Patent 79 10572; French Patent 2,307,491; French Patent 2,454,283; German Offenlegungsschrift 2650969; Swiss Patent 179,261 and U.K. Patent 203,970.

SUMMARY OF THE INVENTION

The present invention seeks to provide a mechanical depilatory device which differs from the prior art devices described above and which provides efficient and relatively painless hair removal.

There is thus provided in accordance with a preferred embodiment of the present invention an electrically powered depilatory device including a hand held portable housing, first and second hair engagement elements defining respective first and second hair engagement surfaces having different surface hardnesses, motor apparatus for driving at least one of the first and second hair engagement elements in relative motion, whereby hair is engaged between the first and second hair engagement surfaces and thus removed.

In accordance with a preferred embodiment of the invention, the difference in surface hardness of the first and second hair engagement elements is such that upon engagement of hair therebetween a recess or depression is defined in the less hard of the two surfaces, at least partially accommodating the engaged hair.

In accordance with a preferred embodiment of the invention, the first hair engagement surface may be defined by an endless belt or band, which may be smooth, conditioned, or configured as appropriate. For example, the belt may be formed with gear teeth. The belt may be flat or curved and may have any suitable cross sectional configuration. It will be appreciated that the terms "belt" and "band" are used in an extremely broad sense to include any type of endless element which can perform depilation as described herein. The second hair engagement surface may be defined by one or more rollers which engage the endless belt or band. The rollers may be of any suitable configuration and, for example, may be straight or curved, smooth or conditioned as appropriate. For example, the rollers may be formed with gear teeth, and may be formed with recesses, slits or any other suitable structural features.

Further in accordance with a preferred embodiment of the invention, the first hair engagement element may comprise one or more rollers and the second hair engagement element may comprise a rotating disk in frictional driving engagement with the roller or rollers.

In accordance with the foregoing embodiment of the invention, the roller or rollers may be smooth or grooved. Where a plurality of rollers is employed, they may be arranged in a plane or otherwise.

Further in accordance with an embodiment of the invention, the first hair engagement element may alternatively comprise an apertured disk.

In accordance with an alternative embodiment of the invention, the second hair engagement element may comprise a plurality of rings instead of a disk and may be smooth or grooved.

Further in accordance with an embodiment of the invention, the first and second hair engagement elements may be arranged such that the relative engagement thereof produces closing of gaps defined in one or both of the engagement elements.

The various features described hereinabove may be combined in any suitable combination in accordance with the present invention.

Additionally in accordance with an embodiment of the invention the relative motion between the first and second hair engagement elements may be rotary, linear or otherwise.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
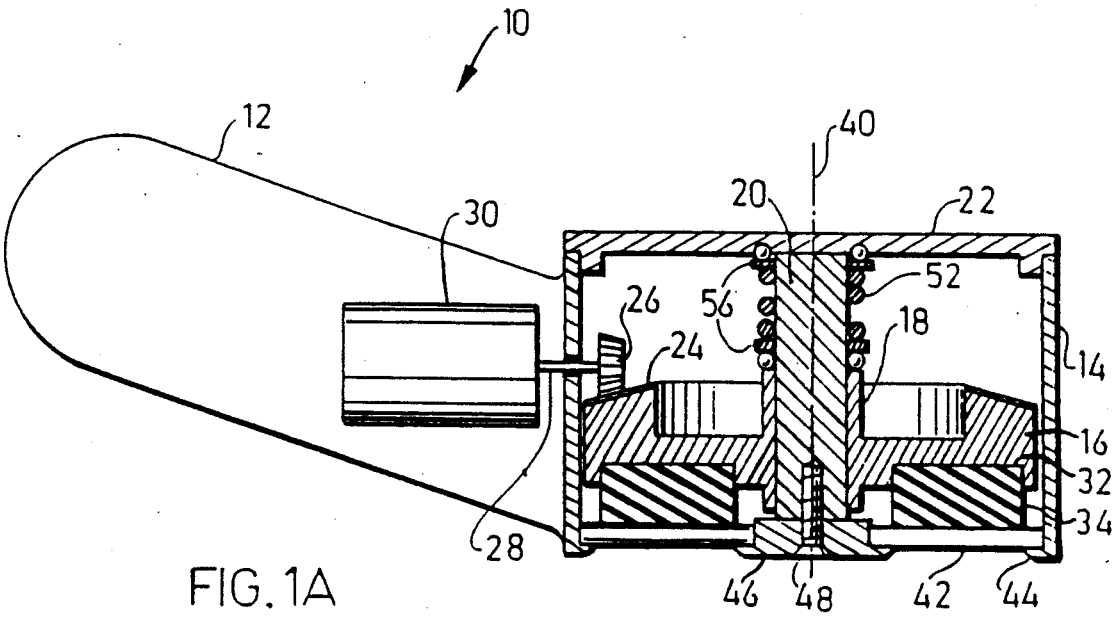
FIG. 1A is a side sectional illustration of a depilatory device constructed and operative in accordance with a preferred embodiment of the invention.
Figure 1B:
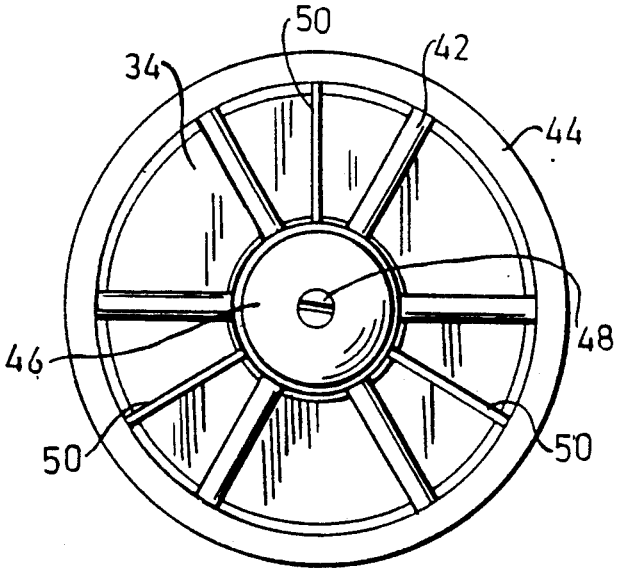
FIG. 1B is a plan view illustration of the operating head portion of the device of FIG. 1A.

Reference is now made to FIGS. 1A and 1B, which illustrate a depilatory device constructed and operative in accordance with a preferred embodiment of the present invention and comprising a housing 10 including a handle portion 12 and an operating head portion 14.

Rotatably mounted within the operating head portion 14 of the housing 10 is a rotating member 16. Member 16 includes a collar portion 18, which is slidably and rotatably mounted on a shaft 20, which is fixedly mounted onto a wall 22 of housing operating head portion 14. Rotating member 16 includes a top surface 24 onto which are formed gear teeth for operative engagement with a gear 26 which is driven by the output shaft 28 of an electric motor 30.

Rotating member 16 also includes a bottom surface which defines a recess 32 into which is fixedly seated an annulus 34 formed of rubber or other material having a high coefficient of friction. Annulus 34 rotates together with member 16 about an axis 40 defined by shaft 20.

A plurality of rollers 42 are rotatably mounted for rotation driven by frictional engagement with annulus 34. Rollers 42 are typically rotatably retained between a peripheral rim 44 preferably formed as part of housing operating head portion 14 and a center retaining plate 46, which may be removably mounted onto shaft 20, as by a screw 48. A plurality of connecting elements 50 may be fixed to retaining plate 46 and extend generally radially outward into engagement with rim 44.

A compression spring 52 is seated at one end onto wall 22 and at its opposite end onto member 16. At each end a pressure bearing 56, comprising a plurality of balls and a washer, is provided in order to enable spring 52 to remain static notwithstanding rotation of element 16. Spring 52 is operative to urge member 16 and annulus 34 into driving frictional engagement with rollers 42.

The device of FIGS. 1A and 1B operates generally as follows. When the operating head is located in propinquity to hair bearing skin, the rotational motion of annulus 34 in frictional engagement with rollers 42 causes rotation of rollers 42 and tends to draw individual hairs into frictional engagement between the annulus 34 and the rollers 42. Continued rotational motion of the annulus 34 and a roller 42 engaging a hair therebetween tends to quickly pull the hair out of the skin. Preferably the annulus 34 rotates at a rotational speed of about 800 rpm, while rollers 42 rotate at a rotational speed of about 7000 rpm and at generally the same linear speed as that of the annulus 34.

Figure 2A:
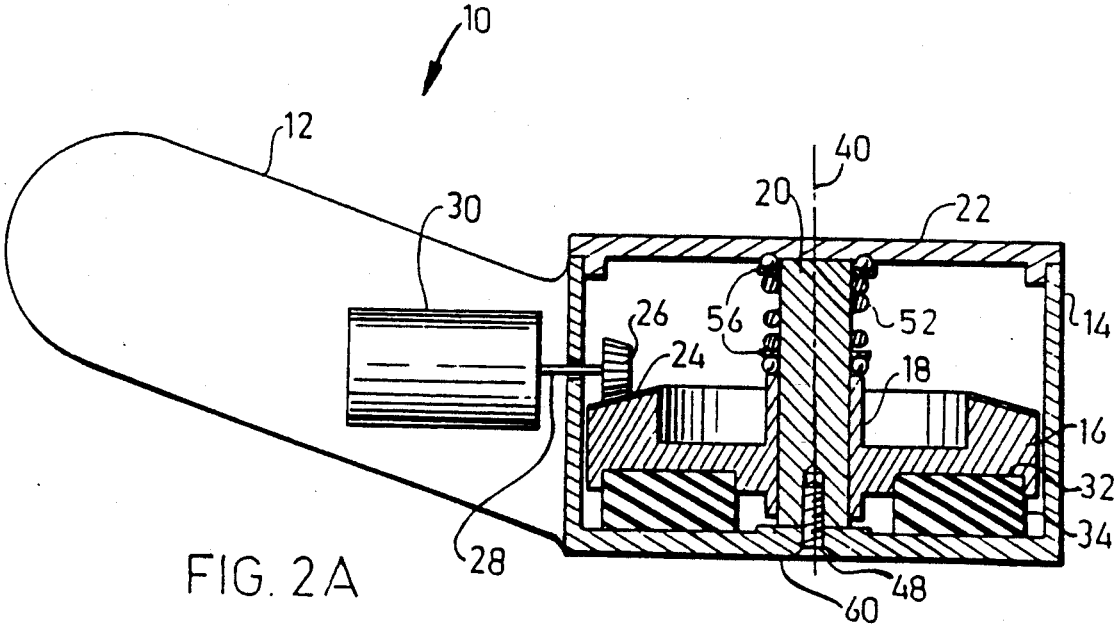
FIG. 2A is a side sectional illustration of a depilatory device constructed and operative in accordance with another preferred embodiment of the invention.
Figure 2B:
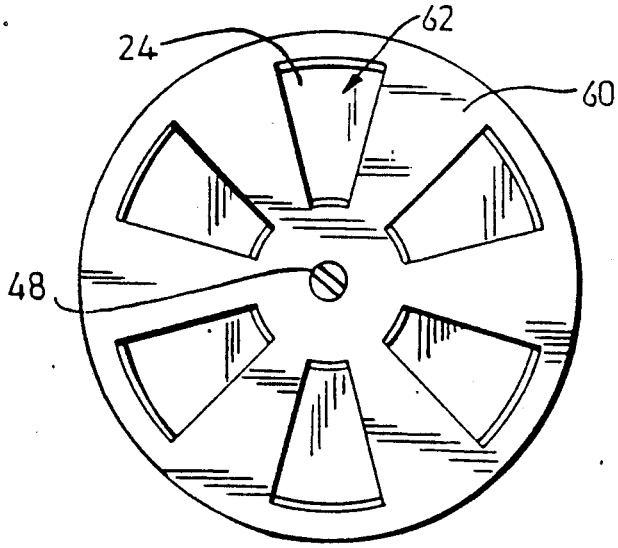
FIG. 2B is a plan view illustration of the operating head portion of the device of FIG. 2A.

Reference is now made to FIGS. 2A and 2B, which illustrate an alternative embodiment of the present invention which is generally identical to that shown in FIGS. 1A and 1B, with the following exception. Instead of rotatable rollers 42, there is provided a static operating head cover 60 having spaced apertures 62. For convenience, identical reference numerals are employed in FIGS. 1A and 2A to indicate identical components.

In the embodiment of FIGS. 2A and 2B, when the operating head is located in propinquity to hair bearing skin, the rotational motion of annulus 34 tends to draw individual hairs extending through apertures 62 into frictional engagement between the annulus 34 and the cover 60. Continued rotational motion of the annulus 34 and the cover 60 tends to quickly pull the hair out of the skin. Preferably the annulus 34 rotates at a rotational speed of about 800 rpm relative to the cover 60.

Figure 3A:
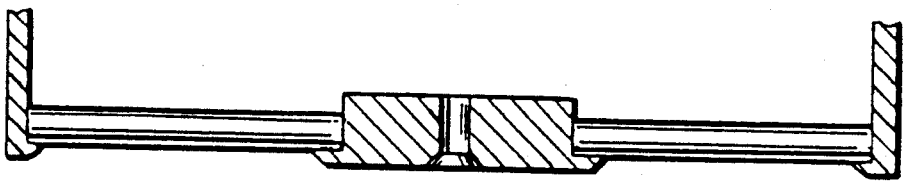
FIGS. 3A, 3B and 3C illustrate three alternative roller surfaces useful in the embodiment of FIGS. 1A and 1B.
Figure 3B:
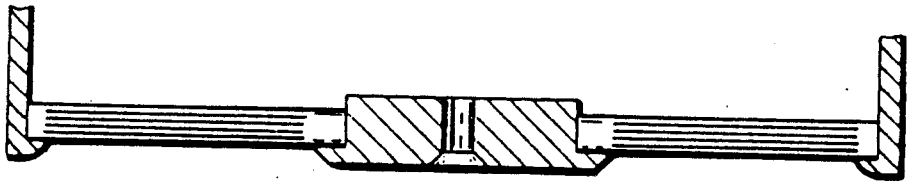
Figure 3C:
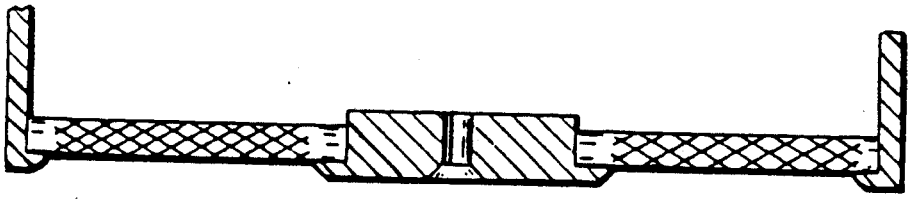

Reference is now made to FIGS. 3A–3C, which illustrate three alternative roller configurations for the embodiment of FIGS. 1A and 1B. FIG. 3A illustrates the provision of smooth surfaced rollers, which may be formed of any suitable material, such as metal, plastic or rubber. FIG. 3B illustrates the provision of rollers having longitudinal grooves to enhance the frictional engagement of the rollers with the annulus 34 (FIG. 1A) and the hair, while FIG. 3C illustrates the use of rollers having a roughened surface to enhance the frictional engagement thereof with the annulus 34 and the hair.

Figure 4A:
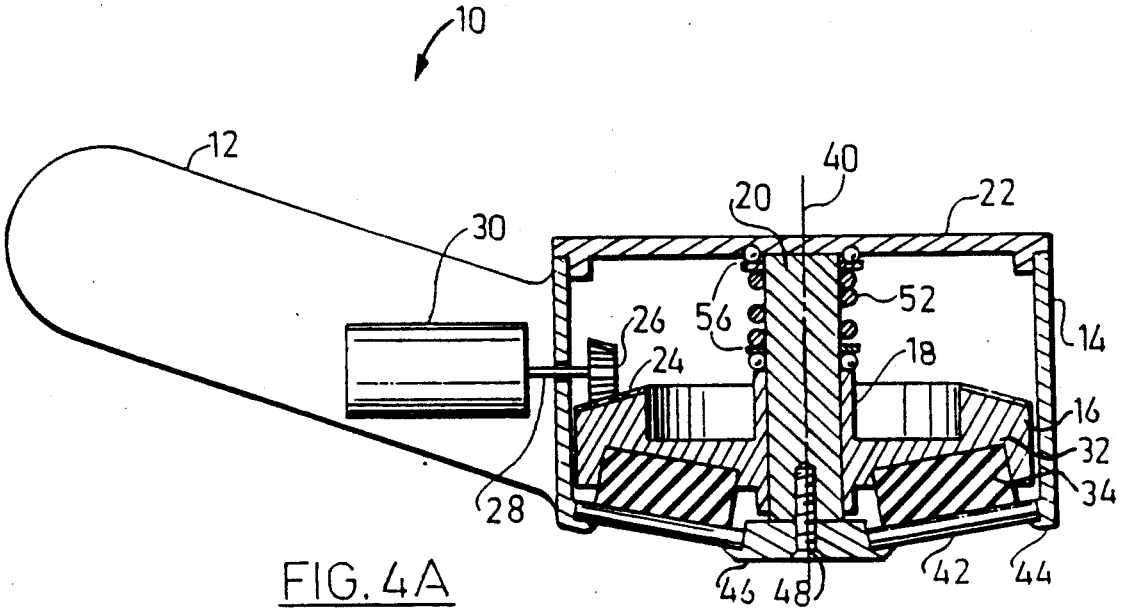
FIG. 4A is a side sectional illustration of a depilatory device constructed and operative in accordance with a further preferred embodiment of the invention.
Figure 4B:
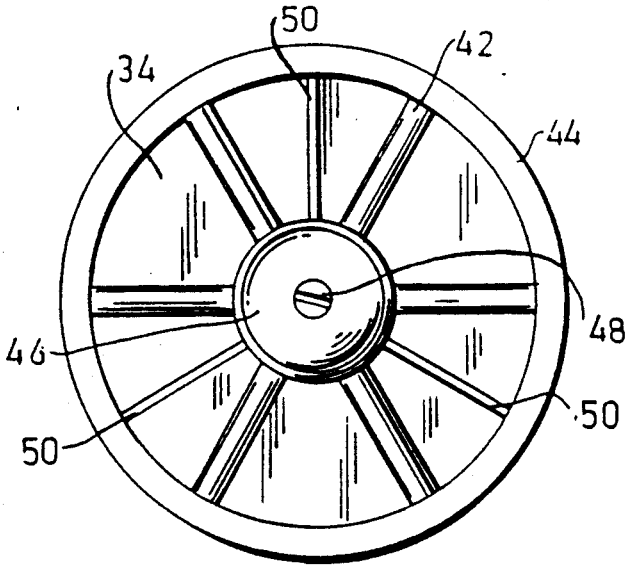
FIG. 4B is a plan view illustration of the operating head portion of the device of FIG. 4A.

Reference is now made to FIGS. 4A and 4B, which illustrate an alternative embodiment of the invention, identical to that illustrated in FIGS. 1A and 1B, with the following exception. Whereas in the embodiment of FIGS. 1A and 1B, the annulus 34 and the rollers 42 lie in respective parallel planes, here, both the annulus 34 and the rollers 42 are arranged to lie over a truncated generally conical surface. A possible advantage of this arrangement is enhanced ease of engagement with certain regions of the body. For convenience, in FIGS. 4A and 4B identical reference numerals are employed as in FIGS. 1A and 1B for the various elements of the apparatus, notwithstanding the different geometrical orientation of some of the elements.

Figure 5A:
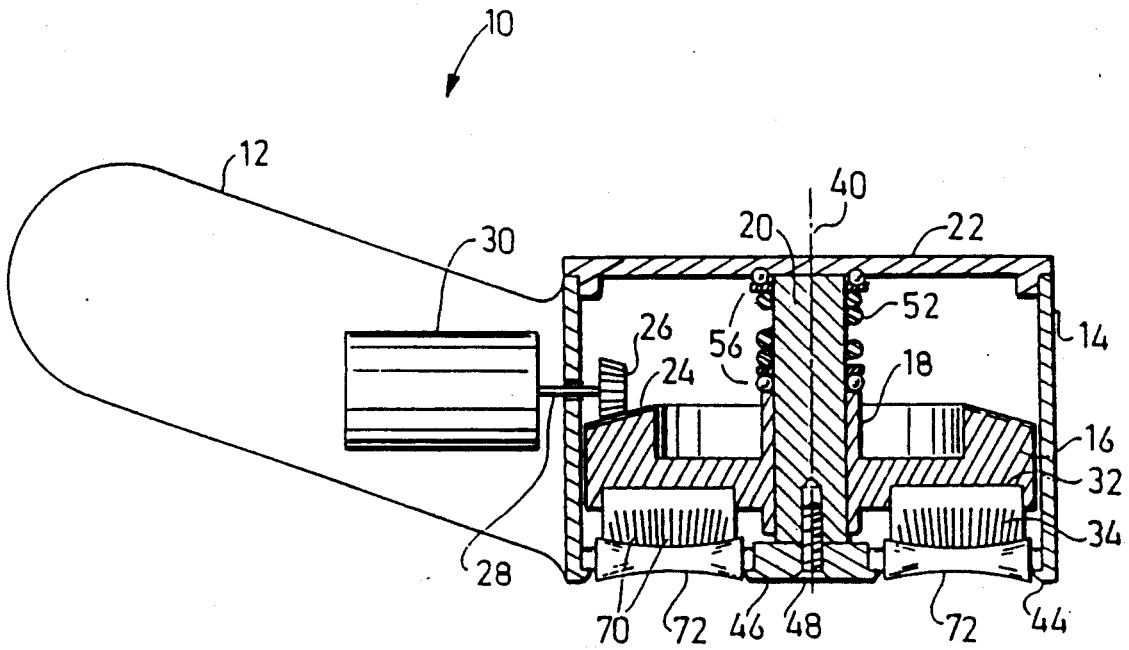
FIG. 5A is a side sectional illustration of a depilatory device constructed and operative in accordance with a still further preferred embodiment of the invention.
Figure 5B:
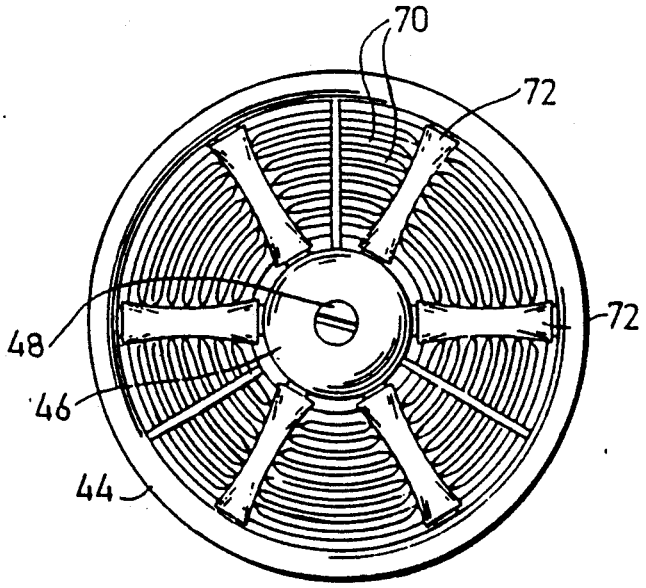
FIG. 5B is a plan view illustration of the operating head portion of the device of FIG. 5A.

Reference is now made to FIGS. 5A and 5B, which illustrate a further alternative embodiment of the present invention which is generally identical to that of FIGS. 1A and 1B with the following exceptions. In the embodiment of FIGS. 5A and 5B, the bottom surface, preferably, of annulus 34 is formed with a multiplicity of generally circumferentially extending slits 70. Curved rollers 72 are employed for frictional engagement with the annulus 34 and for simultaneously forcing the slits together, as illustrated. Curved rollers 72 are typically formed with varying cross-sectional radii, preferably such that the cross-sectional radii are longest at the ends of the roller and are shortest at the midpoint of the roller.

The structure of FIGS. 5A and 5B provides enhanced hair engagement inasmuch as it permits hair to enter slits 70 when the slits are spread, i.e. between engagements with rollers 72. When rotation of the annulus brings a given portion of the annulus into engagement with a curved roller 72, the slit is squeezed closed, trapping engaged hairs therewithin and generally causing them to be pulled out of the skin.

Figure 6A:
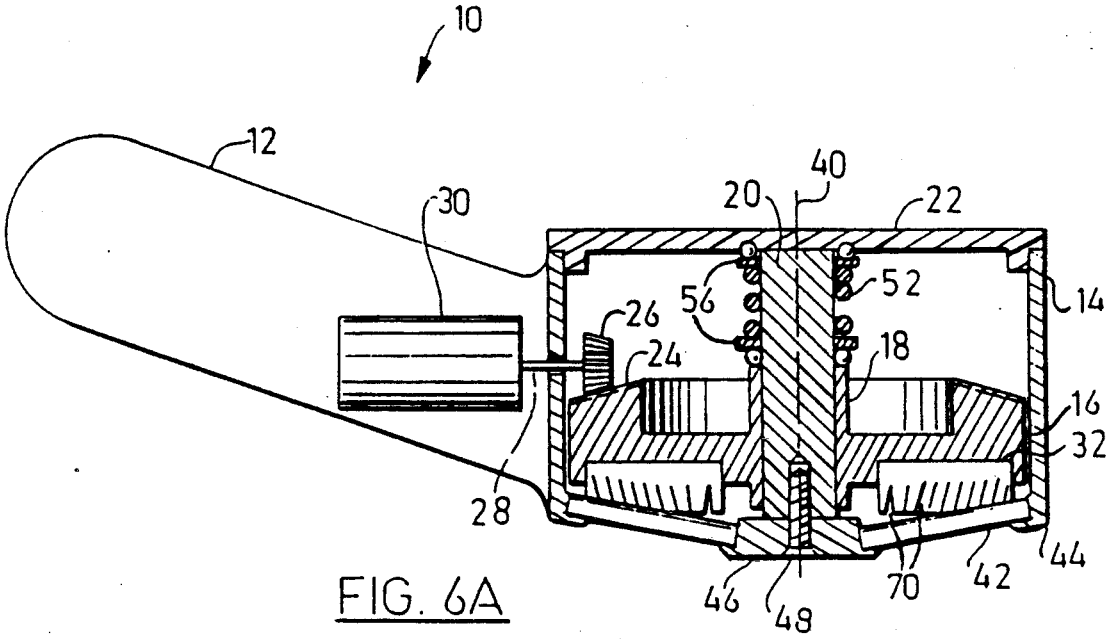
FIG. 6A is a side sectional illustration of a depilatory device constructed and operative in accordance with a still further preferred embodiment of the invention.
Figure 6B:
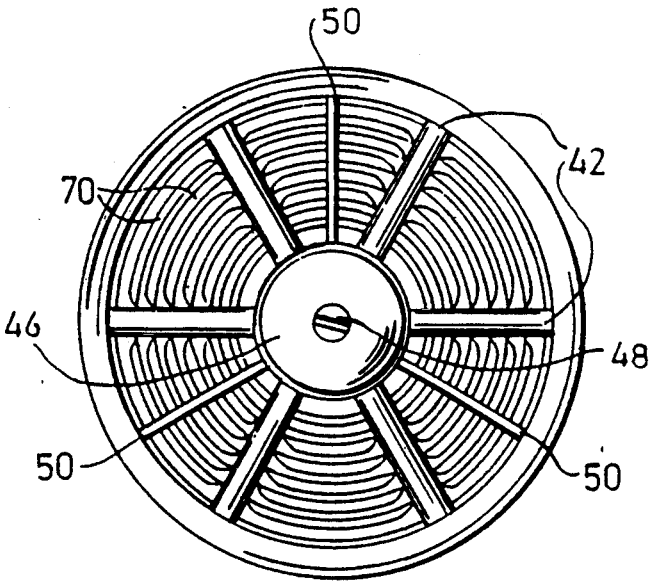
FIG. 6B is a plan view illustration of the operating head portion of the device of FIG. 6A.

Reference is now made to FIGS. 6A and 6B, which illustrate a further alternative embodiment of the invention which is essentially similar to that of FIGS. 5A and 5B but employs straight rollers 42 (i.e., rollers of generally uniform cross-section) disposed along a generally truncated, preferably conical surface, as illustrated in FIG. 4A. As distinguished from the embodiment of FIG. 4A, however, the annulus 34 remains essentially planar, such that the pressure engagement of angularly disposed straight rollers 42 with the annulus 34 bearing slits 70 produces squeezing together of the slits 70.

Operation of the apparatus of FIGS. 6A and 6B is essentially identical to that described hereinabove in connection with FIGS. 5A and 5B.

Figure 7:
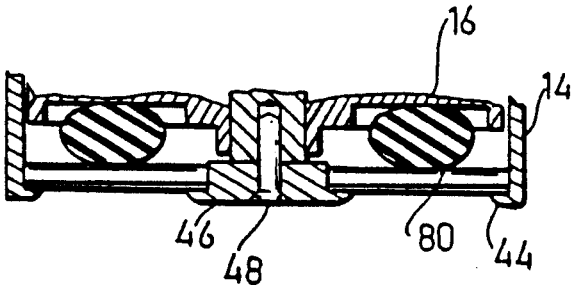
FIG. 7 illustrates an alternative operating head configuration useful in the embodiment of FIGS. 1A and 1B.

Reference is now made to FIG. 7 which illustrates an alternative operating head configuration useful in the embodiment of FIGS. 1A and 1B. The embodiment of FIG. 7 is identical to that employed in the apparatus of FIGS. 1A and 1B except that the annulus 34 of FIG. 1A is replaced by a ring 80 having a generally circular, ovular, elliptical or otherwise curved cross-section, the remainder of the structure remaining generally the same.

Figure 8A:
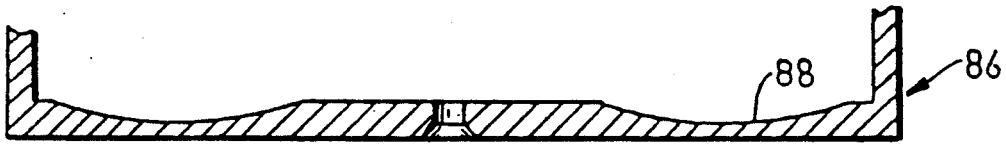
FIGS. 8A and 8B are sectional illustrations of two alternative configurations of the head portion of the embodiment of FIGS. 2A and 2B.
Figure 8B:
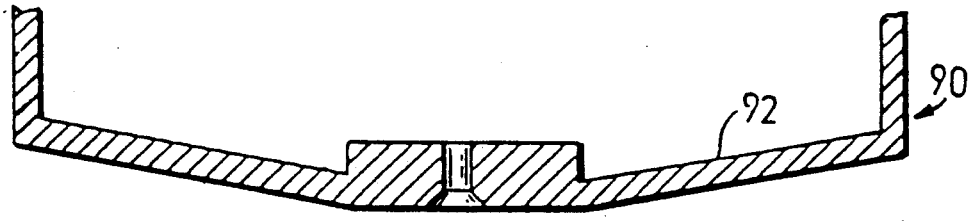

Reference is now made to FIGS. 8A and 8B, which illustrate two alternative embodiments of a static operating head cover useful in the embodiment of FIGS. 2A and 2B. FIG. 8A illustrates an operating head cover 86 defining a curved inner surface 88 which is particularly suitable for engagement with an annulus 34 of the type shown in FIG. 5A having slits 70, for squeezing the slits together.

FIG. 8B illustrates a static operating head cover 90 defining an inner surface 92 having a truncated generally conical configuration, as in the analogous roller embodiment of FIG. 6A. This embodiment is similarly particularly suitable for engagement with an annulus 34 of the type illustrated in FIG. 6A having slits 70, for squeezing the slits together.

Figure 9A:
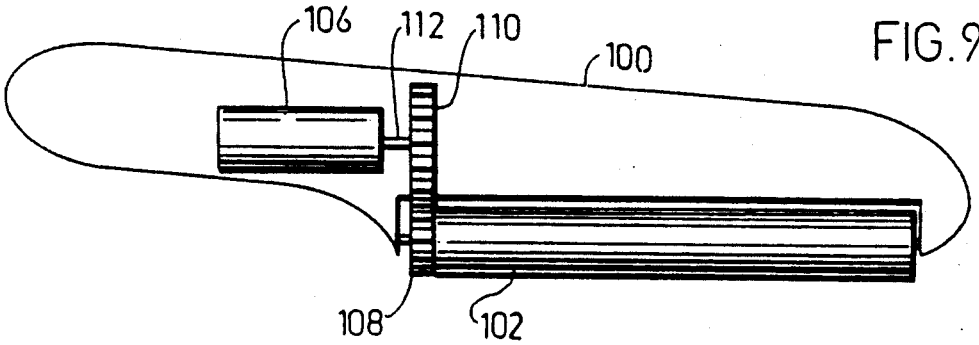
FIG. 9A is a side sectional illustration of a depilatory device constructed and operative in accordance with a still further preferred embodiment of the invention.
Figure 9B:
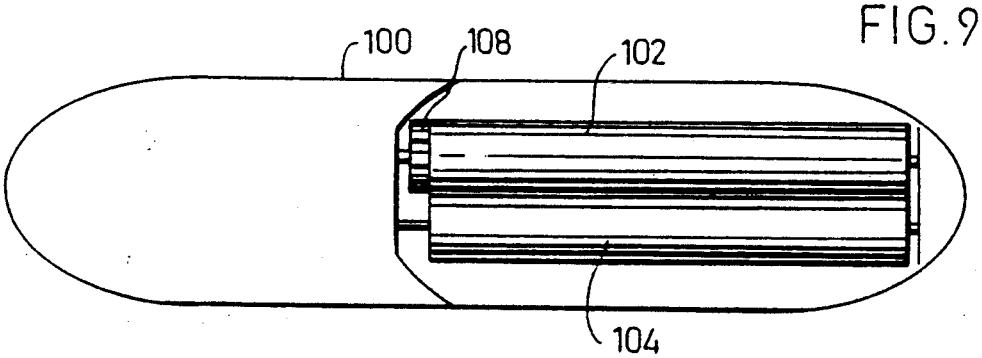
FIG. 9B is a plan view illustration of the operating head portion of the device of FIG. 9A.

Reference is now made to FIGS. 9A and 9B which illustrate an alternative embodiment of a depilatory device comprising a housing 100 in which are rotatably disposed first and second rollers 102 and 104, arranged for mutual frictional engagement. Rollers 102 and 104 are preferably formed of respective resilient materials, typically of two different materials of different hardnesses. A motor 106, disposed in housing 100, is arranged to drive roller 102 in rotary motion via a gear 108 which is affixed to an end of roller 102 and is engaged by a corresponding gear 110, affixed to the output shaft 112 of the motor 106.

Rotational motion of roller 102 produces corresponding rotational motion of roller 104 in an opposite direction, due to the frictional engagement between the two rollers. The relative motion of the two rollers may engage hair therebetween and pull the hair into the recess or deformation produced in one or each of the rollers when they are pressed against one another.

Figure 10A:
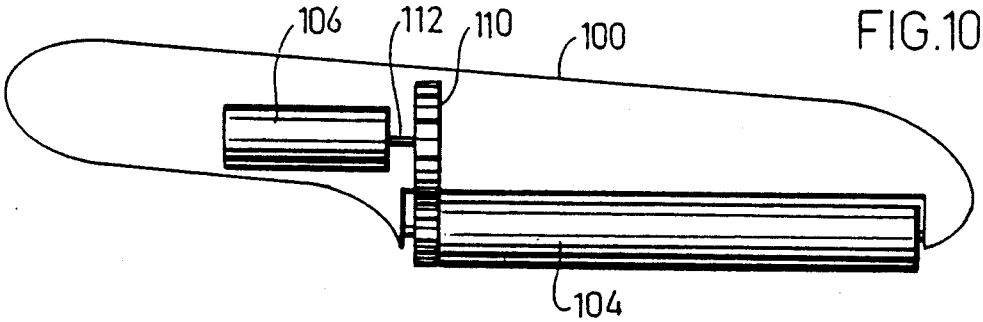
FIG. 10A is a side sectional illustration of a depilatory device constructed and operative in accordance with a still further preferred embodiment of the invention.
Figure 10B:
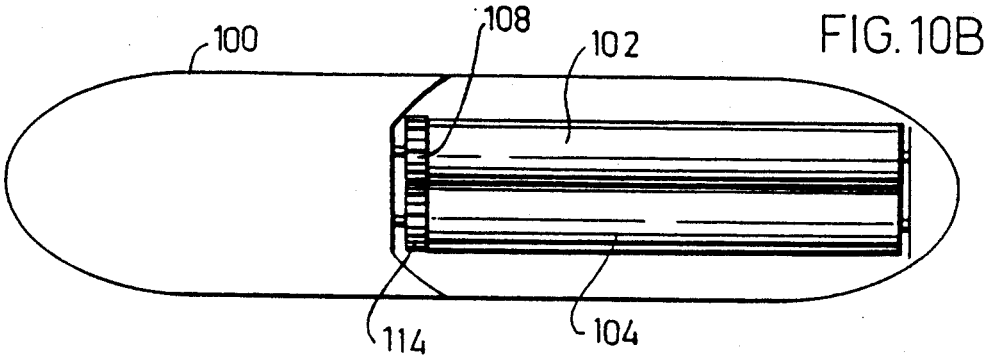
FIG. 10B is a plan view illustration of the operating head portion of the device of FIG. 10A.

Reference is now made to FIGS. 10A and 10B, which illustrate an alternative embodiment of the depilatory device of FIGS. 9A and 9B wherein the difference lies in the fact that the two rollers are coupled by gearing, there being provided an additional gear 114, which engages gear 108 and is affixed to the end of roller 104. Otherwise, the structure and operation of the two embodiments is the same.

Figure 11C:
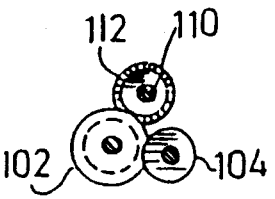
FIG. 11C is a sectional illustration taken along the lines C—C in FIG. 11A.
Figure 11A:
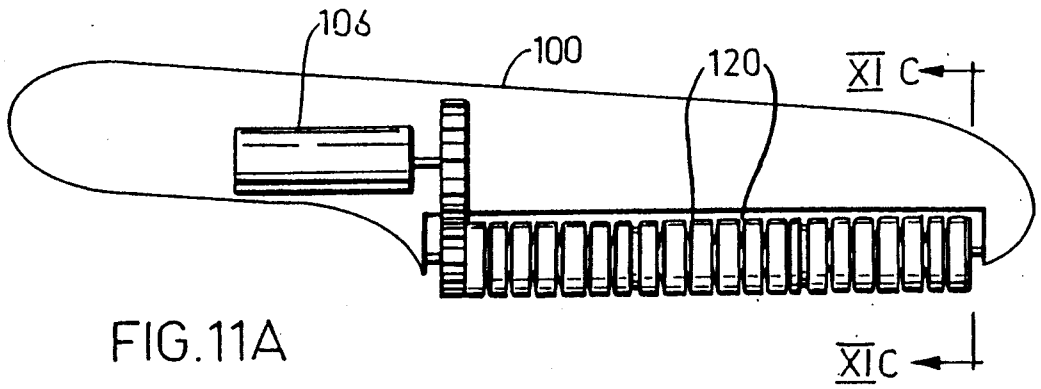
FIG. 11A is a side sectional illustration of a depilatory device constructed and operative in accordance with a still further preferred embodiment of the invention.
Figure 11B:
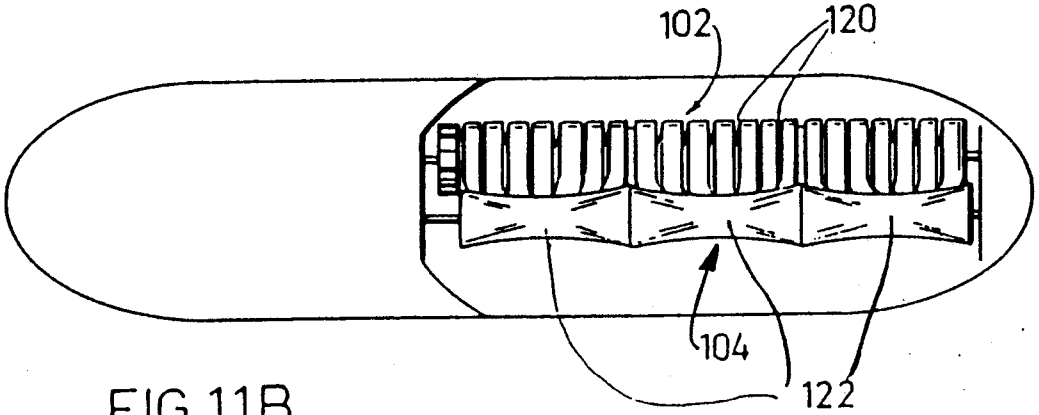
FIG. 11B is a plan view illustration of the operating head portion of the device of FIG. 11A.

Reference is now made to FIGS. 11A–11C, which illustrate a further alternative embodiment of the depilatory device of FIGS. 9A and 9B. Here roller 102 is formed of a relatively soft resilient material, such as rubber, having multiple circumferential slits 120 spaced along its length, and roller 104 is formed of a relatively hard material such as plastic, and comprises a series of curved elongate sections 122 (i.e. sections with varying cross-sectional radii, preferably such that the cross-sectional radii are longest at the ends of each section and are shortest at the midpoint of each section) which press the slits together for grasping hair which has entered the slits, thereby causing fixed entrapment of the hair therewith and enhanced pulling thereby of the hair from the skin.

Figure 12C:
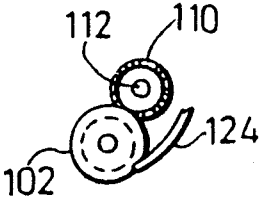
FIG. 12C is a sectional illustration taken along the lines C—C in FIG. 11A.
Figure 12A:
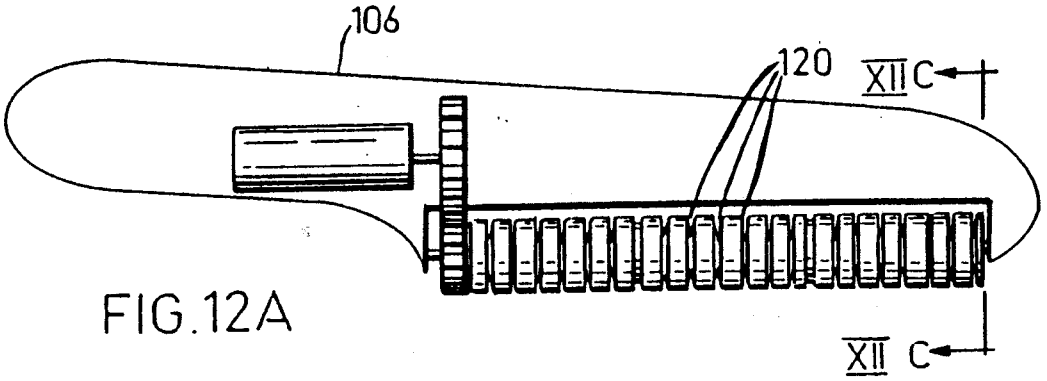
FIG. 12A is a side sectional illustration of a depilatory device constructed and operative in accordance with a still further preferred embodiment of the invention.
Figure 12B:
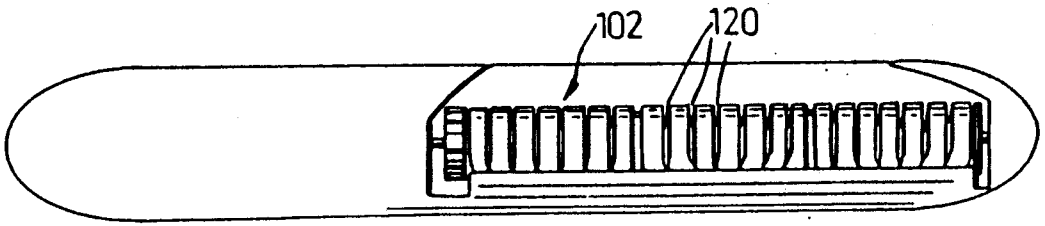
FIG. 12B is a plan view illustration of the operating head portion of the device of FIG. 12A.

Reference is now made to FIGS. 12A–12C, which illustrate still another alternative embodiment of the depilatory device of FIGS. 9A and 9B. As in the embodiment of FIGS. 11A through 11C, roller 102 is formed of a relatively resilient material, such as rubber, and has multiple circumferential slits 120 at intervals along its length, but here roller 104 is replaced by a static engagement member 124 which engages roller 102 and is operative to press the slits 120 together for grasping hair which has entered the slits, thereby causing fixed entrapment of the hair therewith and enhanced pulling thereby of the hair from the skin.

Figure 13B:
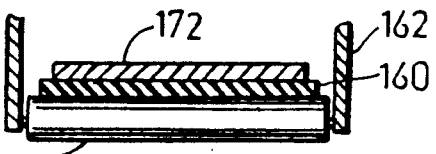
FIG. 13B is a sectional view illustration of the operating head portion of the device of FIG. 13A taken along lines B—B of FIG. 13A.
Figure 13A:
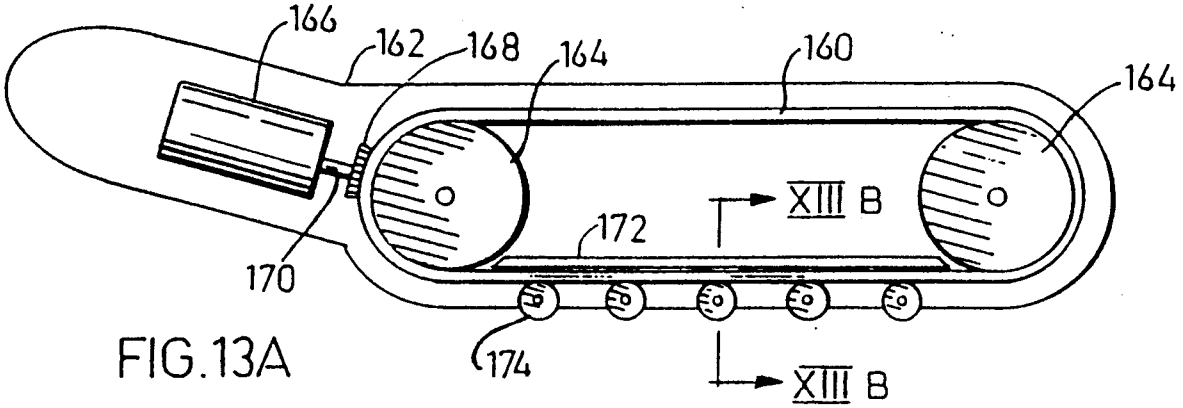
FIG. 13A is a side sectional illustration of a depilatory device constructed and operative in accordance with a still further preferred embodiment of the invention.

Reference is now made to FIGS. 13A and 13B, which illustrate a further alternative embodiment of the invention. Here an endless band or belt 160, typically formed of a resilient material such as rubber, is disposed within a housing 162 on support rollers 164. A motor 166, also disposed interiorly of housing 162, drives one of the support rollers 164 via a gear 168 which is affixed to the drive shaft 170 of the motor 166.

A platen element 172, which may be generally planar as shown or alternatively may comprise a plurality of rollers, is disposed interiorly of the band 160. A plurality of rollers 174 are operative to maintain a pressure engagement of the band 160 against platen element 172, such that linear motion of the band 160 produces corresponding rotation of rollers 174. Hair may be engaged between the various rollers and the bands for producing hair removal.

Figure 14B:
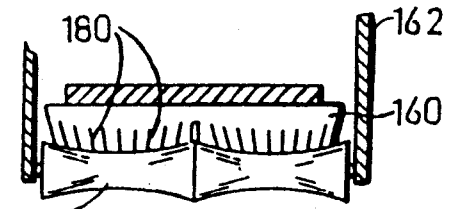
FIG. 14B is a sectional view illustration of the operating head portion of the device of FIG. 14A taken along lines B—B of FIG. 14A.
Figure 14A:
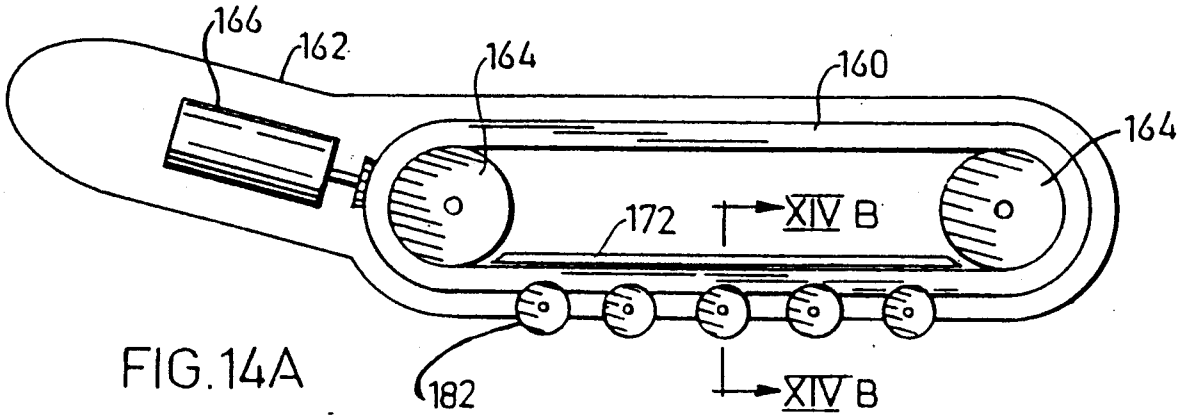
FIG. 14A is a side sectional illustration of a depilatory device constructed and operative in accordance with a still further preferred embodiment of the invention.

Reference is now made to FIGS. 14A and 14B, which illustrate an alternative embodiment of the apparatus of FIGS. 13A and 13B, the difference being in the structure of the band and the rollers. Here, analogous to the structure of FIG. 5A, the outer surface of band 160 is provided with elongate slits 180. The rollers 182 are configured to be curved (i.e. with varying cross-sectional radii, preferably such that the cross-sectional radii are longest at the ends of the roller and are shortest at the midpoint of the roller) such that engagement between the rollers 182 and the band 160 serves to squeeze the slits together, thus trapping hair which may have entered gaps defined by the slits.

Figure 15A:
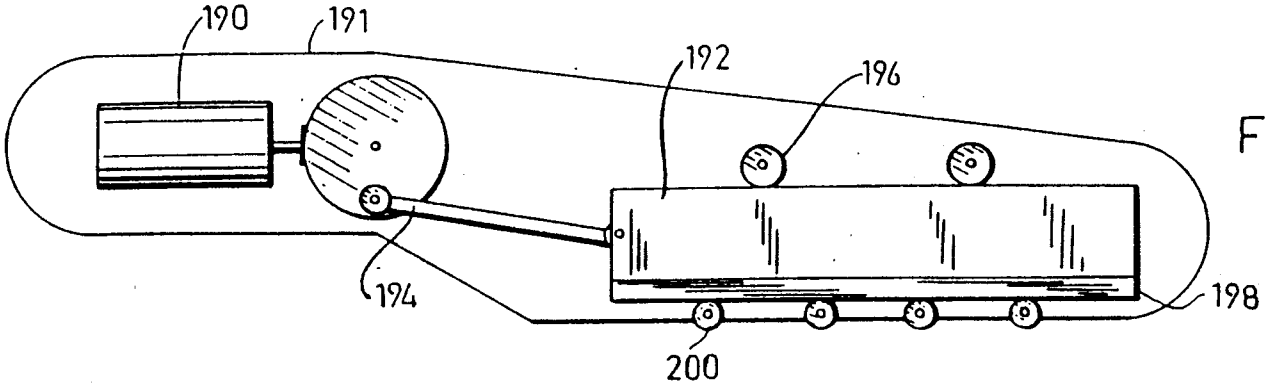
FIG. 15A is a side sectional illustration of a depilatory device constructed and operative in accordance with a still further preferred embodiment of the invention.
Figure 15B:
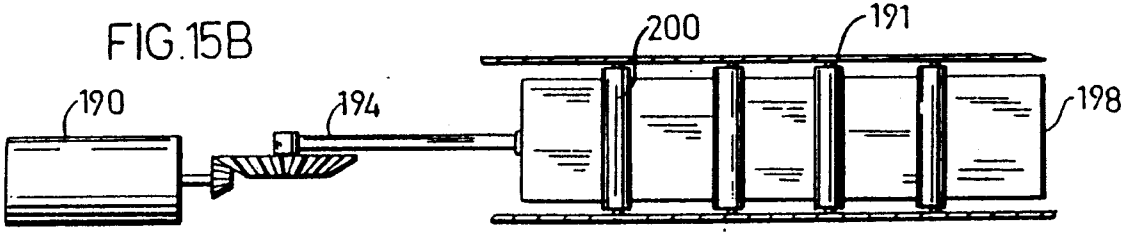
FIG. 15B is a plan view illustration of the operating head portion of the device of FIG. 15A.

Reference is now made to FIGS. 15A and 15B, which illustrate a further alternative embodiment of the invention. Here a motor 190, disposed in a housing 191, produces reciprocating linear motion of a platen element 192 via a crankshaft drive 194. Platen element 192 is supported for linear motion by support rollers 196 and defines a preferably resilient bottom surface 198, typically formed of rubber.

A plurality of rollers 200 are disposed, typically in a mutually parallel orientation, in pressure engagement with the bottom surface 198, thereby defining engagement locations between each of rollers 200 and bottom surface 198. Recesses may be formed at these locations if rollers 200 are harder than surface 198.

Figure 16E:
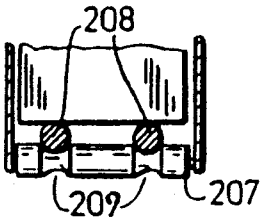
FIGS. 16A, 16B, 16C, 16D and 16E are sectional illustrations of five alternative embodiments of the device of FIGS. 15A and 15B.
Figure 16D:
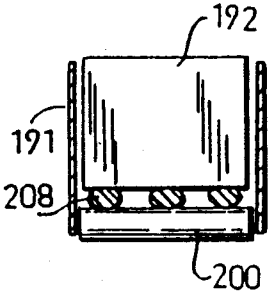
Figure 16C:
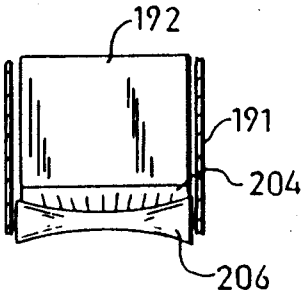
Figure 16B:
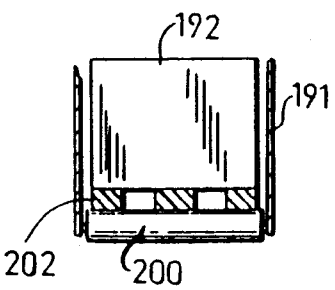
Figure 16A:
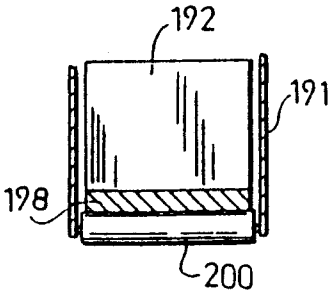

Reference is now made to FIGS. 16A–16E, which illustrate five alternative configurations of bottom surface 198 and of rollers 200. In FIG. 16A, the bottom surface 198 is generally uniform and generally planar and the rollers 200 are straight (i.e. of generally uniform cross section). In the embodiment of FIG. 16B, the bottom surface 198 comprises a plurality of spaced strips 202, preferably having generally rectangular cross-sections, and the rollers 200 are of generally uniform cross section.

In the embodiment of FIG. 16C, the bottom surface 198 is formed with a plurality of elongate slits 204 and the rollers 206 are curved (i.e. with varying cross-sectional radii preferably such that the cross-sectional radii are longest at the ends of the roller and are shortest at the midpoint of the roller), analogous to the embodiment of FIG. 14B. In the embodiment of FIG. 16D, the bottom surface 198 comprises a plurality of strips 208 having generally circular, ovular or elliptical cross sections and the rollers 200 are straight.

It is appreciated that the surfaces of rollers 200 may be smooth, grooved or otherwise conditioned.

FIG. 16E illustrates an alternative embodiment of the invention, similar to that illustrated in FIG. 16D. In this embodiment, the cylindrical rollers 200 are replaced by rollers 207 having formed therein annular recesses 209 at locations corresponding to strips 208. Recesses 209 typically have generally curved configurations, which need not be of the same shape as the cross-sections of strips 208.

Figure 17A:
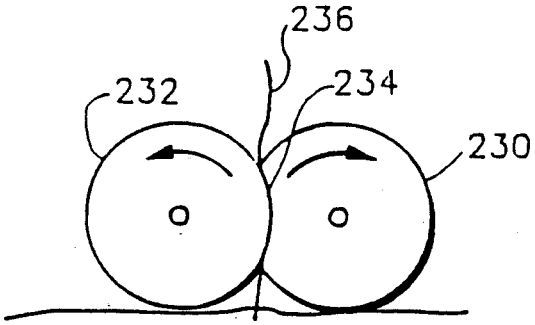
FIGS. 17A, 17B, 17C, 17D and 17E are illustrations of the engagement of hair according to various embodiments of the present invention.
Figure 17B:
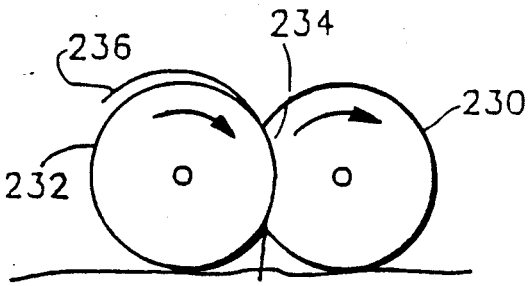

Reference is now made to FIGS. 17A–17E, which illustrate the engagement of hair provided in accordance with the present invention. FIG. 17A illustrates a construction, such as that shown in FIGS. 9A, 9B, 9C and 9D, wherein two rollers 230 and 232 are employed for engaging hair. In the embodiment of FIGS. 17A and 17B, roller 230 is relatively soft and roller 232 is relatively hard, such that frictional engagement therebetween produces a recess or deformation 234 in roller 230, as shown. It is appreciated that the creation of a recess 234 provides enhanced hair engagement due to the relatively large dimensions of the surface over which the hair is pressed between the two rollers. This arrangement also avoids localized pressure between the rollers on the hair which could cause breakage of the hair, thereby precluding effective uprooting thereof from the skin.

FIG. 17A illustrates a situation wherein the hair 236 extends generally straight through and past the rollers and FIG. 17B illustrates a situation wherein the hair 236 becomes wound around one of the rollers. It is immaterial which of the two situations occurs in practice. Normally, some of the hairs tend to pass straight through as in FIG. 17A and some tend to become wound as in FIG. 17B.

Figure 17C:
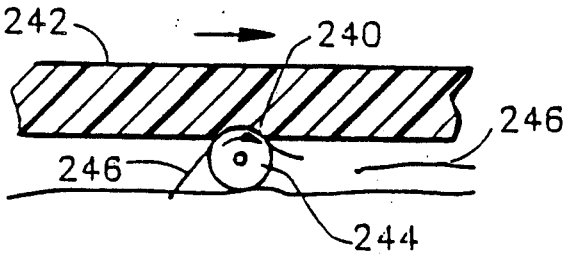
Figure 17D:
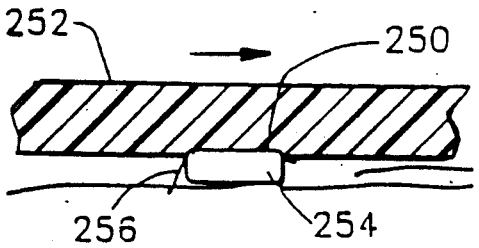
Figure 17E:
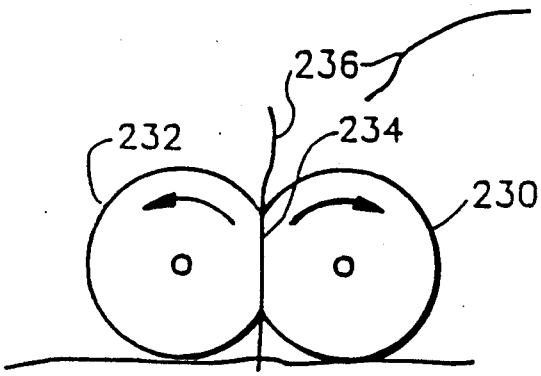

FIG. 17E illustrates a situation wherein both of the rollers are of similar hardness. In this situation deformations are formed in both of the rollers 230 and 232, the deformations defining a generally planar interface 234 at the mutual boundary of the rollers, whose cross sections are otherwise generally circular. The deformations are defined by the amount of deviation from the circular configuration, of the cross sections of the rollers.

Reference is now made to FIG. 17C which illustrates the hair engagement characteristic of the embodiments of FIGS. 1A, 1B, 4A, 4B, 5A, 5B, 6A, 6B, 13A, 13B, 14A, 14B, 15A, 15B, 16A–16E and 18A–18C. Here it is seen that a recess or deformation 240 is defined in a relatively soft annulus 242 by pressure engagement with a relatively harder roller 244. The hair 246 passes between the roller and the annulus and is engaged within recess 240, the engagement being enhanced by the relatively large surface area defined by the recess. It is appreciated that, herein, the terms "recess" and "deformation" are and have been used interchangeably in a broad sense.

Reference is now made to FIG. 17D which illustrates the hair engagement characteristic of the embodiment of FIGS. 2A and 2B. Here it is seen that a recess 250 is defined in a relatively soft annulus 252 by pressure engagement with a relatively harder cover 254. The hair 256 passes between the cover and the annulus and is engaged in recess 250, the engagement being enhanced by the relatively large surface areas thus defined by the recess.

Figure 18A:
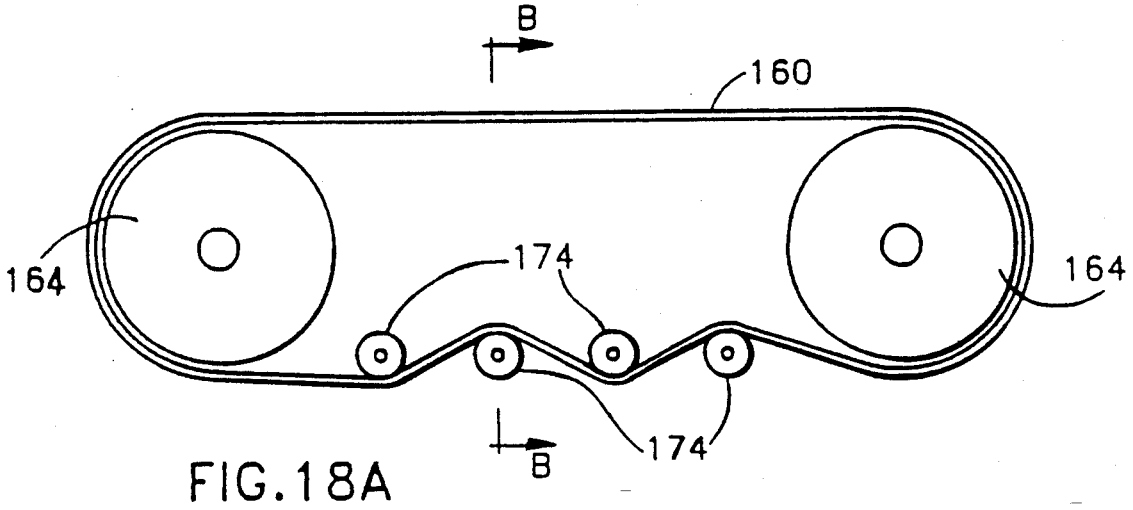
FIG. 18A is a side sectional illustration of a depilatory device constructed and operative in accordance with a still further preferred embodiment of the invention.
Figure 18B:
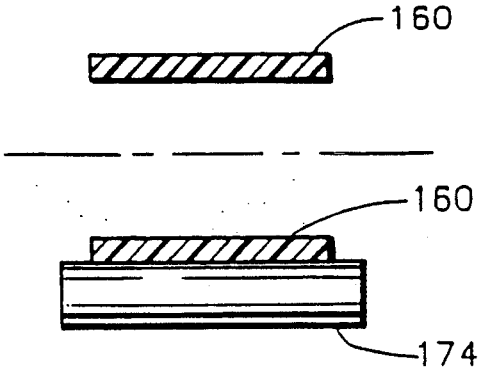
FIG. 18B is a sectional view illustration of the operating head portion of the device of FIG. 18A taken along lines B—B of FIG. 18A.
Figure 18C:
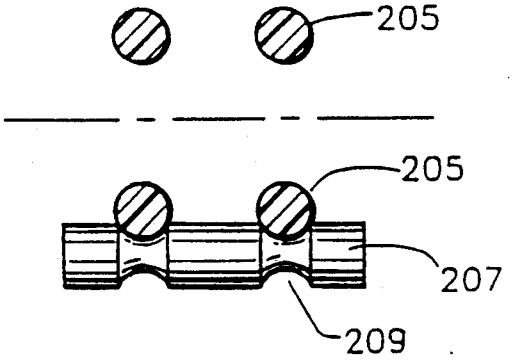
FIG. 18C is a sectional view illustration of an alternative embodiment of the structure shown in FIGS. 18A and 18B.

Reference is now made to FIGS. 18A and 18B which illustrate an alternative embodiment of the structure of FIGS. 13A, 13B, 14A and 14B. In this embodiment, the platen member 172 is eliminated and rollers 174 are located on both sides of the endless band or belt 160. Preferably, adjacent rollers are located on opposite sides of band 160. FIG. 18C illustrates an alternative embodiment of the invention, similar to that illustrated in FIG. 16E, wherein the single endless band or belt 160 is replaced by a plurality of endless bands, belts or rings 205, arranged in a generally mutual parallel orientation and typically of generally circular cross section. In this embodiment, rollers 207 have formed therein annular recesses 209 at locations corresponding to rings 205. Recesses 209 typically have generally curved configurations, which need not be of the same shape as the cross-sections of bands 205.

Figure 19A:
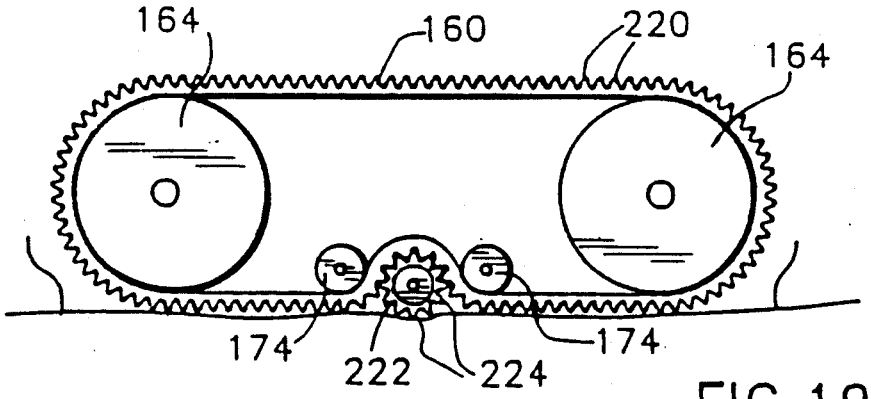
FIG. 19A is a side sectional illustration of a depilatory device constructed and operative in accordance with yet a further preferred embodiment of the invention.

Reference is now made to FIG. 19A which illustrates apparatus generally similar to that of FIG. 18A wherein the endless belt 160 is formed with gear teeth 220, preferably located on its outer surface. The belt 160 is driven by gear engagement with a driving roller 222 which is formed with gear teeth 224 engaging gear teeth 220.

Figure 19B:
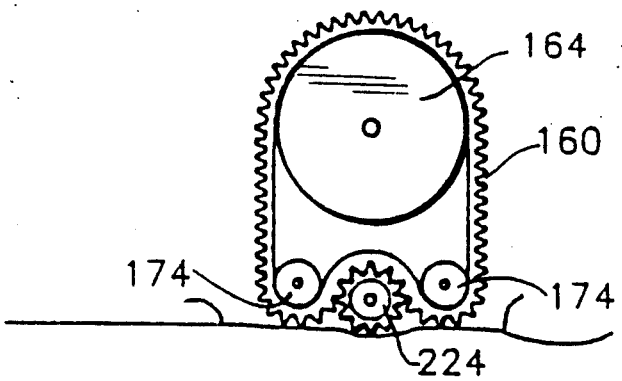
FIG. 19B is a side sectional illustration of a depilatory device constructed and operative in accordance with yet another preferred embodiment of the invention.

FIG. 19B illustrates a somewhat different configuration of the embodiment of FIG. 19A in that only one support roller 164 is provided.

Figure 19C:
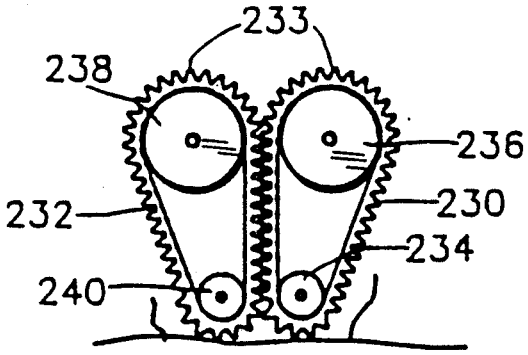
FIG. 19C is a side sectional illustration of a depilatory device constructed and operative in accordance with still another preferred embodiment of the invention.

FIG. 19C illustrates a further alternative embodiment of the invention wherein a pair of belts 230 and 232 preferably having interdigitated gear teeth 233 are arranged to be driven in synchronization by at least one of rollers 234, 236, 238 and 240.

It will be appreciated that the various structural alternatives described above may be combined in any suitable configuration. Thus, for example, the configurations illustrated in section in FIGS. 13B and 14B may also be used in the embodiments of FIGS. 15A and 15B.

It is appreciated that the various features illustrated in the drawings and described above may be combined in any suitable combination.

It will be appreciated by persons skilled in the art that the present invention is not limited to what has been particularly shown and described hereinabove. Rather the scope of the present invention is defined only by the claims which follow:

We claim:

1. An electrically powered human hair depilatory device comprising:

a hand held portable housing;

first and second hair engagement elements defining respective first and second hair engagement surfaces having different surface hardnesses; and motor means for driving at least one of said first and second hair engagement elements in relative motion, whereby hair is engaged between said first and second hair engagement surfaces and thus removed, and wherein said second hair engagement element comprises an annular element having a generally flat hair engaging surface and being arranged for rotation about a first axis such that said generally flat hair engaging surface lies in a plane perpendicular to said first axis; and said first hair engagement element comprises at least one elongate element extending along a second axis which is generally perpendicular to said first axis, said elongate element being in frictional engagement with said generally flat hair engaging surface.

2. An electrically powered human hair depilatory device according to claim 1 and wherein said first hair engagement element comprises at least one roller.

3. An electrically powered human hair depilatory device according to claim 1 and wherein said first and second hair engagement elements are configured and arranged such that at least one of said first and second hair engagement elements bears slits, each said slit being in a relatively closed orientation when the first and second hair engagement elements are relatively engaged, each said slit being in a relatively open orientation when the first and second hair engagement elements are relatively disengaged.

4. An electrically powered human hair depilatory device according to claim 1 and wherein said first hair engagement element comprises a static member.

5. An electrically powered human hair depilatory device according to claim 1 and wherein said first and second hair engagement elements are selected from among the following elements: roller, belt, disk.

6. An electrically powered human hair depilatory device according to claim 1 and wherein said first hair engagement element comprises a belt and said second hair engagement element comprises a plurality of rollers.

7. An electrically powered human hair depilatory device according to claim 6 and wherein hair is engaged for removal between an endless belt and at least one roller.

8. An electrically powered human hair depilatory device according to claim 6 and wherein individual ones of said plurality of rollers are disposed on both sides of said belt.

9. An electrically powered human hair depilatory device according to claim 6 and wherein individual ones of said plurality of rollers are disposed on both sides of said belt.

10. An electrically powered human hair depilatory device according to claim 6 and wherein said rollers are formed with at least one annular recess therein and said belt comprises at least one band engaging said at least one annular recess.

11. An electrically powered human hair depilatory device according to claim 7 and wherein said rollers are formed with at least one annular recess therein and said belt comprises at least one band engaging said at least one annular recess.

12. An electrically powered human hair depilatory device comprising:

a hand held portable housing;

first and second hair engagement elements defining respective first and second hair engagement surfaces, wherein said second hair engagement element comprises a rotary driven disk having a flat hair engagement surface in frictional driving engagement with said first engagement element; and motor means for driving at least one of said first and second hair engagement elements in relative motion, whereby hair is engaged between said first and second hair engagement surfaces and thus removed.

13. An electrically powered human hair depilatory device according to claim 12 and wherein said first hair engagement element comprises at least one roller.

14. An electrically powered human hair depilatory device according to claim 2 and wherein said at least one roller is grooved.

15. An electrically powered human hair depilatory device according to claim 2 and wherein said at least one roller comprises a plurality of rollers.

16. An electrically powered human hair depilatory device according to claim 13 and wherein said at least one roller comprises a plurality of rollers.

17. An electrically powered human hair depilatory device according to claim 12 and wherein said first hair engagement element comprises at least one varying cross sectioned roller. engagement elements are configured and arranged such that at least one of said first and second hair engagement elements bears slits, each said slit being in a relatively closed orientation when the first and second hair engagement elements are relatively engaged, each said slit being in a relatively open orientation when the first and second hair engagement elements are relatively disengaged.

18. An electrically powered human hair depilatory device according to claim 12 and wherein said first and second hair engagement elements are configured and arranged such that at least one of said first and second hair engagement elements bears slits, each said slit being in a relatively closed orientation when the first and second hair engagement elements are relatively engaged, each said slit being in a relatively open orientation when the first and second hair engagement elements are relatively disengaged.

19. An electrically powered human hair depilatory device according to claim 12 and wherein said first hair engagement element comprises a static member.

* * * * *